United States Patent [19]

Henze et al.

[11] Patent Number: 4,754,717

[45] Date of Patent: Jul. 5, 1988

[54] SEWING ARRANGEMENT FOR COVERS MADE OF TEXTILE MATERIAL, E.G. PILLOW CASES, SLIP COVERS OR THE LIKE

[75] Inventors: Siegfried Henze, Hohenroth; Martin Schnaus, Grosseibstadt, both of Fed. Rep. of Germany

[73] Assignee: Texpa-Arbter Maschinenbau GmbH, Saal/Saale, Fed. Rep. of Germany

[21] Appl. No.: 80,506

[22] Filed: Jul. 31, 1987

[51] Int. Cl.[4] ..... D05B 13/00; D05B 21/00

[52] U.S. Cl. ..... 112/10; 112/121.12; 112/306

[58] Field of Search ..... 112/10, 121.11, 121.12, 112/121.15, 306

[56] References Cited

U.S. PATENT DOCUMENTS

| | | | |
|---|---|---|---|
| 2,940,404 | 6/1960 | Damon | 112/10 |
| 3,126,848 | 3/1964 | Gastonquay | 112/10 |
| 3,232,256 | 2/1966 | Buckalter | 112/121.12 X |
| 4,224,883 | 9/1980 | Ziegler, Jr. et al. | 112/10 |
| 4,621,585 | 11/1986 | Ball et al. | 112/10 |
| 4,624,198 | 11/1986 | Beam et al. | 112/10 |
| 4,685,407 | 8/1987 | Junemann | 112/121.12 X |

*Primary Examiner*—H. Hampton Hunter

*Attorney, Agent, or Firm*—Cushman, Darby & Cushman

[57] ABSTRACT

To produce pillow cases, bed sheets or like covers 10 fully automatically, a first transporting device 17 for the sections 24 cut off a supply of fabric 16 is provided in a sewing arrangement which supplies the sections 24 to a folding station 28. There each section of fabric 24 is folded over an aligning plate 32 by means of a folding bar 29 which can be moved back and forth. Above said aligning plate 32, a device 36 for the edge alignment of each folded section of fabric 24 is provided which is controllable in respect to the respective offset of the two layers 31, 33 of the folded section of fabric 24. A second transporting device 60 takes up the folded and aligned sections of fabric 24 and transports them to a first sewing station 61 where the two layers 31, 33 of the sections of fabric 24 are sewn together along two aligned edges. A third transport device 65, disposed at right angles to the second transport device 60, then transports the sections of fabric 24 to a second sewing station 67, where the two layers 31, 33 of the sections of fabric 24 are sewn together along two further aligned edges. The cover 10 is then complete and remains open along an edge 11.

14 Claims, 7 Drawing Sheets

Figure 1:
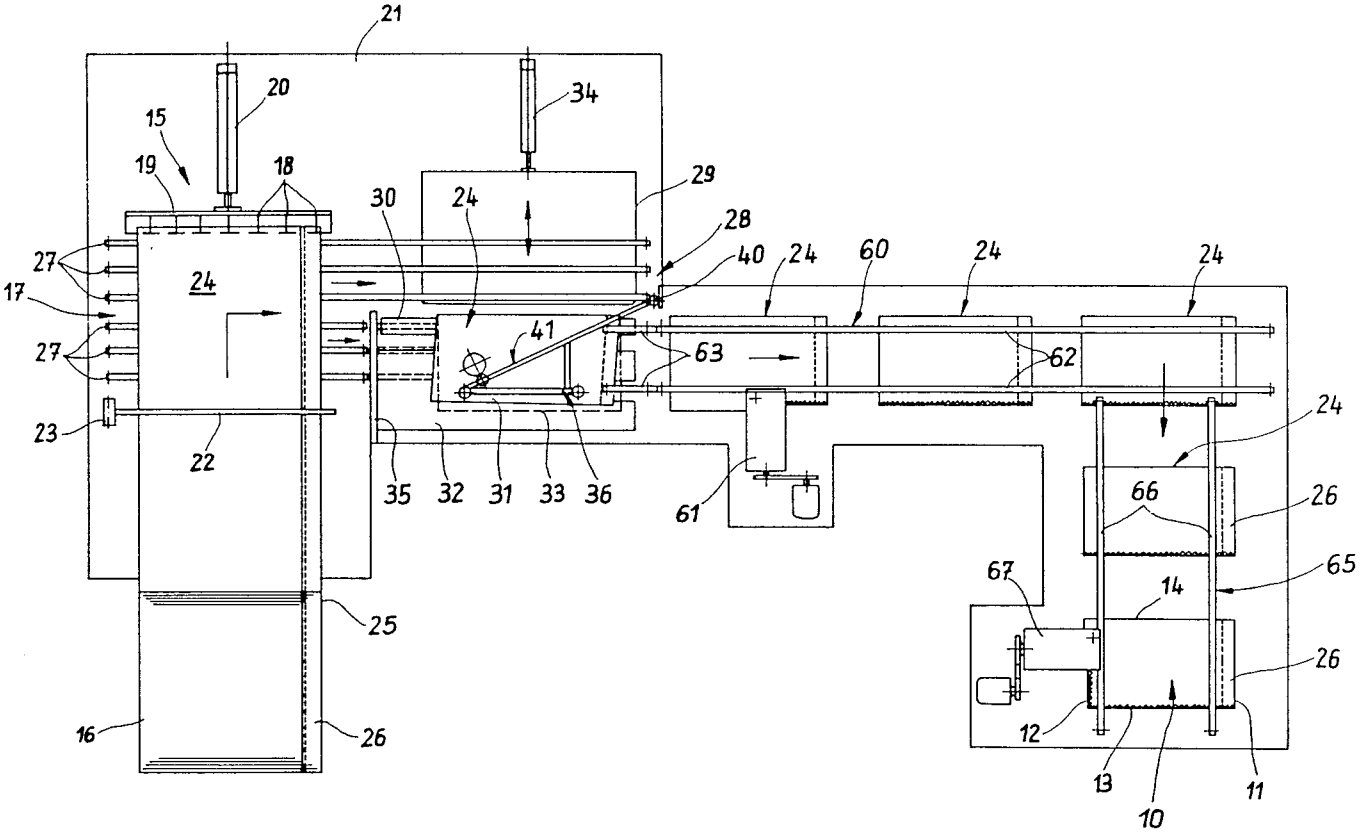

SEWING ARRANGEMENT FOR COVERS MADE OF TEXTILE MATERIAL, E.G. PILLOW CASES, SLIP COVERS OR THE LIKE

The invention relates to a sewing arrangement for covers made of fabric material, e.g. pillow cases, bed sheets or the like, where sections cut from a supply of fabric are made into individual covers.

When folding or wrapping over the sections of material cut from the supply the folded lengths of cloth shift. Even when the sections of cloth are cut off from the supply, tensions in the material can arise which lead to a crosswise displacement of the fabric layers. Therefore the edges of the layers of the folded fabric sections must be aligned before sewing, which up to now was done manually.

It is an object of the invention to provide a sewing arrangement for covers of fabric material wherein the sections of fabric cut from a supply of fabric are folded fully automatically and the two layers of the folded fabric sections are aligned flush with their edges and sewn.

The above object is achieved by a sewing arrangement which is characterized in accordance with the invention by (a) a first transporting device which moves the sections of fabric to a folding station where a folding bar, being movable back and forth in a direction crosswise to the direction of movement of the first transport device, folds each section of fabric across an alignment plate such that one layer of each section of fabric is above the alignment plate and the other layer is below the alignment plate, (b) a device, disposed above the alignment plate and controllable in respect to the offset of the two layers, for the edge-aligned positioning of the upper layer disposed on top of the alignment plate in respect to the lower layer of each section of material, (c) a second transporting device for taking up and further transporting the folded and aligned sections of fabric to a first sewing station where the folded layers of the sections of fabric are sewn together along two aligned edges, and (d) a third transporting device, disposed at right angles to the second transporting device for taking up and further transporting the sections of fabric to a second sewing station where the folded layers of the sections of fabric are sewn together along two additional aligned edges.

In a sewing arrangement having the characteristics according to the invention, both layers of the folded material can be aligned fully automatically in respect to each other and then sewn, so that precisely measured covers or wrappers, e.g. pillow cases or mattress sheets, can be manufactured quickly and economically.

Developments of the invention can be seen from the dependent claims. Thus the device for the edge alignment of the two layers of each section of fabric is practically designed being upwardly and downwardly movable as well as pivotable around a vertical axis.

In accordance with another development of the invention the device has at least two aligning feet which are disposed on an arm pivotable around a vertical axis in such a way that it acts at the upper layer of each section of fabric in the vicinity of the edge located opposite the folding edge. In general, two such aligning feet in this device are sufficient if, for example, pillow cases are produced in the sewing arrangement.

The alignment process is further improved if, in accordance with a further embodiment of the invention, the aligning feet are disposed on the pivot arm in such a way that they act in the area of the two corners on the upper layer of each folded section of fabric.

In a practical manner the aligning feet are disposed on the pivot arm upwardly and downwardly actuable by means of actuation cylinders.

Still another development of the invention is characterized in that the pivot arm of the alignment device is pivoted by means of a motor-driven control disk during the alignment process.

In accordance with a still further development of the invention, the amount of the pivoting of the pivot arms supporting the aligning feet is controlled by a sensing device which senses the offset of the two layers of each section of fabric.

In a preferred embodiment the sensing device has at least three sensors, e.g. photoelectric cells, two of which are fixedly disposed above each other on the pivot arm of the aligning device and the third on the frame of the sewing arrangement.

If photoelectric cells are used as sensing devices and they cooperate with fixed reflector strips, their responsiveness is advantageously increased.

In accordance with still another development of the invention the second transport device for taking up and further transporting the folded and aligned sections of fabric has in a practical way vertically pivotable take-up sections which are upwardly pivoted when each folded section of fabric is aligned and are pivoted downward to take up the aligned sections of fabric.

The taking up and further transporting of the folded and aligned sections of fabric is further improved if at least one cut-out for the admittance of at least one take-up section of the second transport device is provided on the aligning plate.

In a practical way the pivot arm consists of a generally triangular, as seen from above, assembly of bars. A pivot arm of such light construction is particularly easy to control.

If, in accordance with another development of the invention, the folding of the sections of fabric takes place around a plaiting tongue which moves in a plane in alignment with the aligning plate, it is possible in each case to provide a movement between the two layers of each folded section of fabric so that an aligning step takes place in each case. This assures the production of covers or wrappers true to measure.

The invention is described below by means of an exemplary embodiment with the aid of the drawings.

Figure 2:
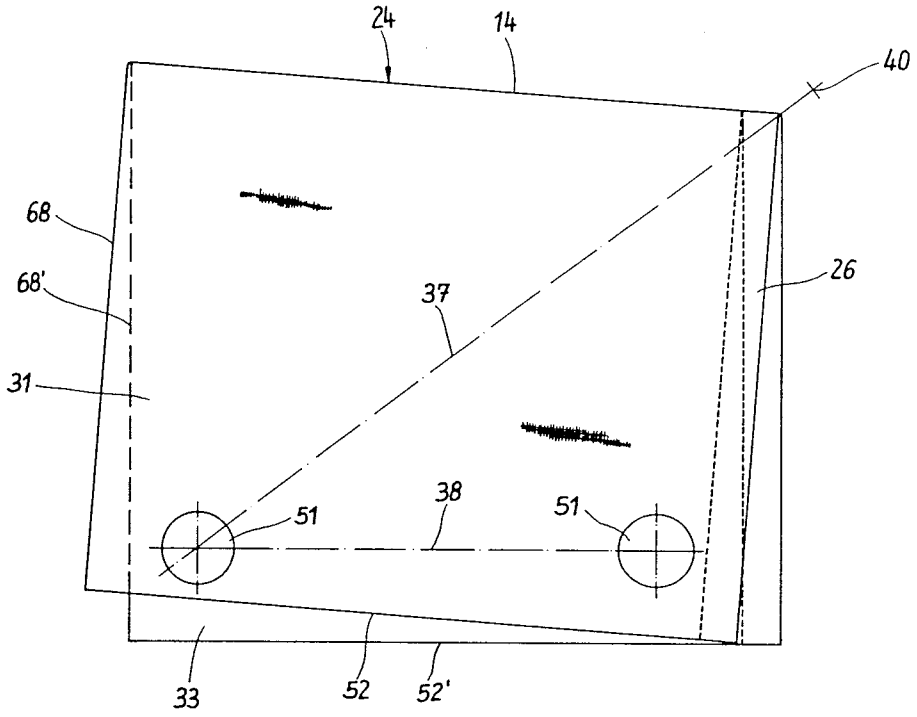
Figure 3:
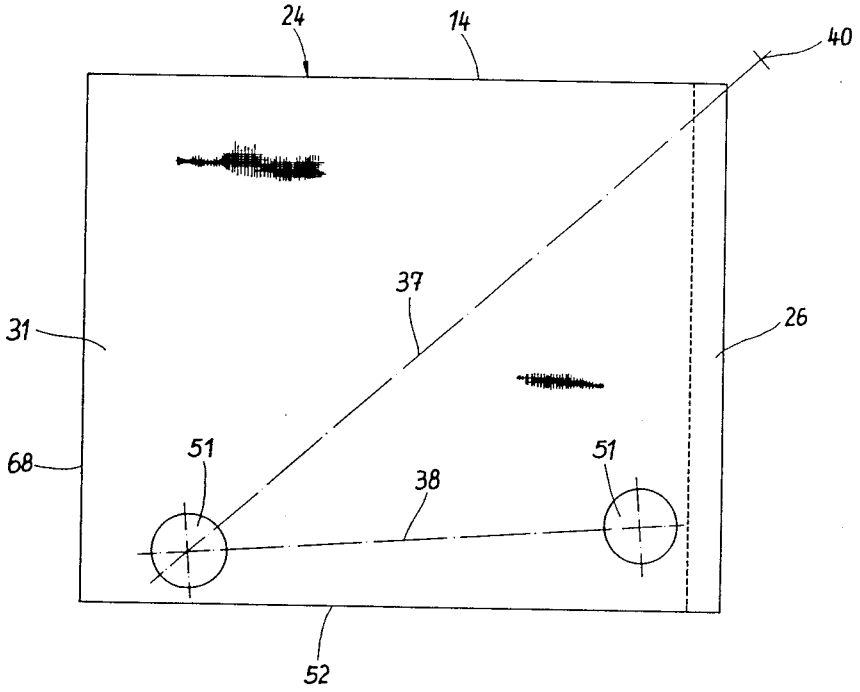
Figure 4:
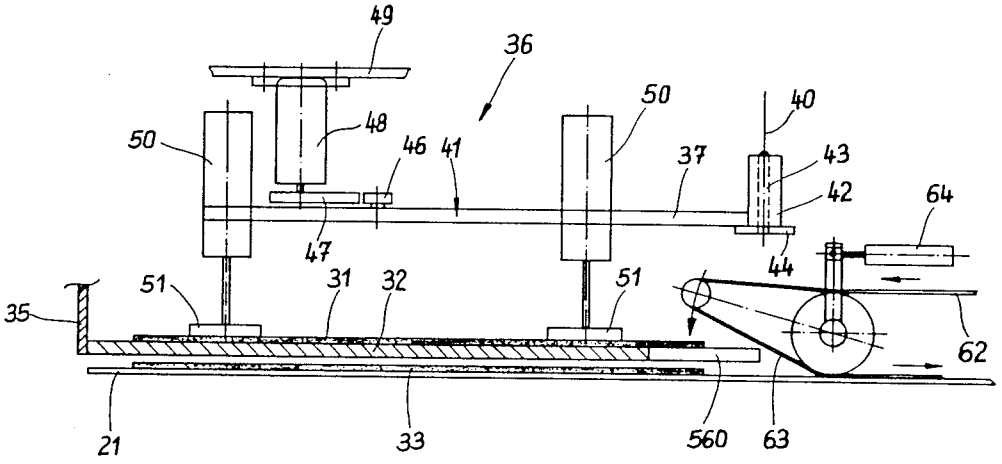
Figure 5:
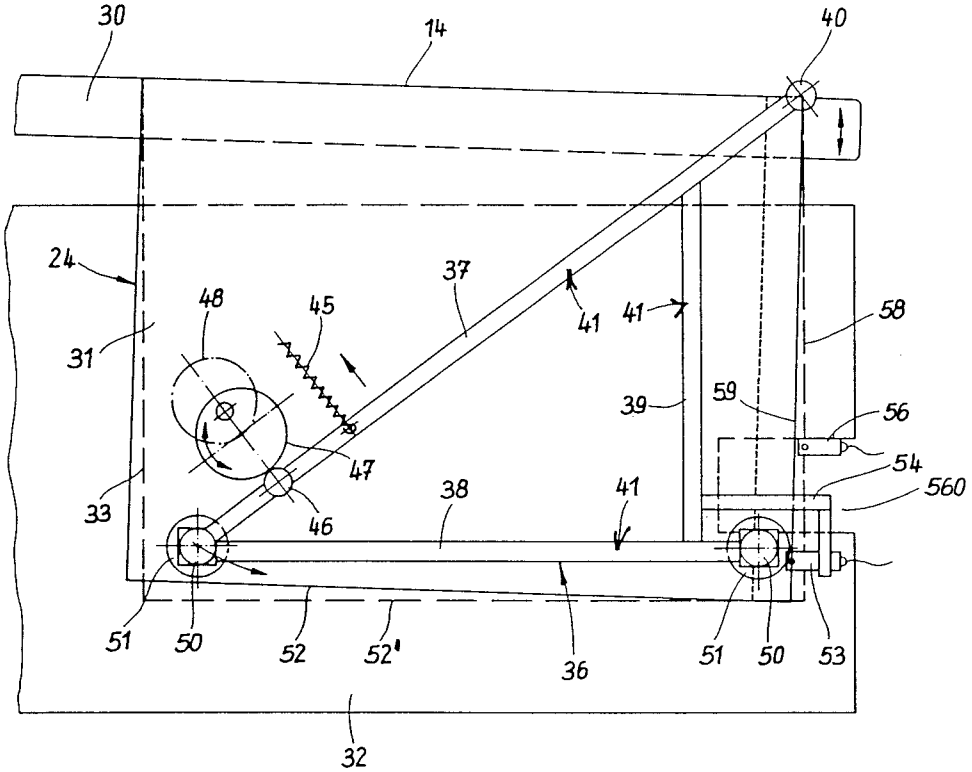
Figure 6:
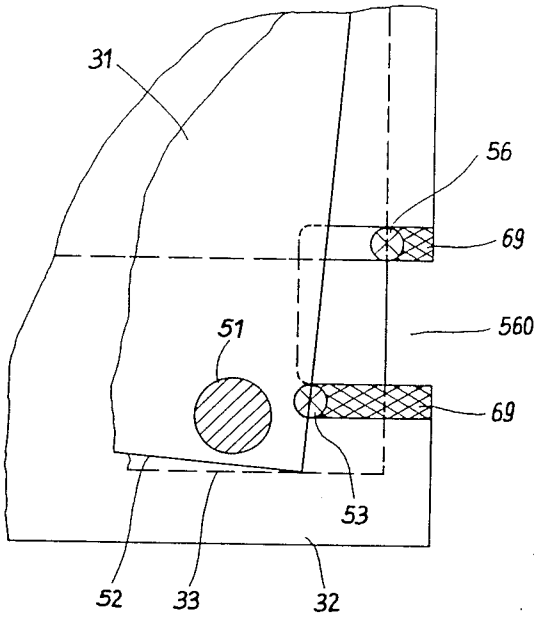
Figure 7:
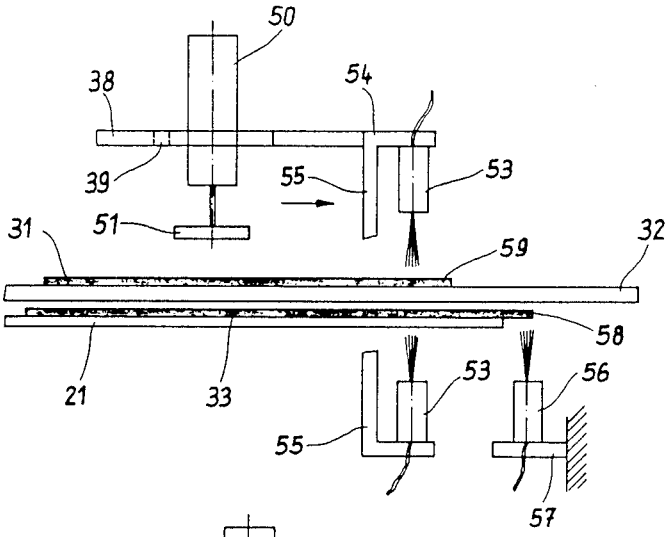
Figure 8:
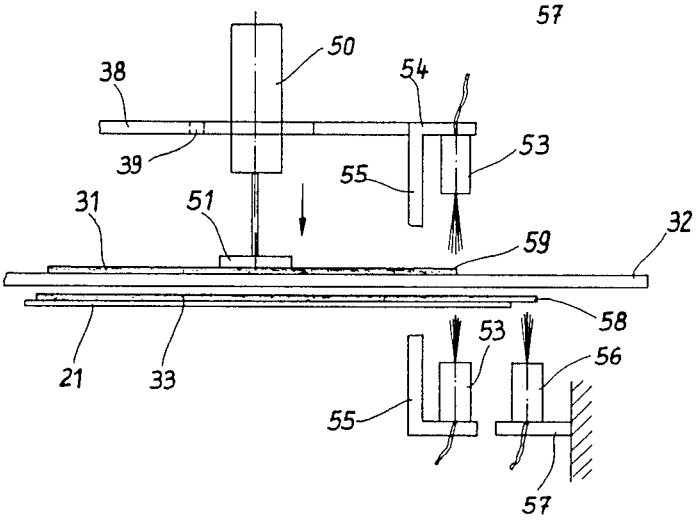
Figure 9:
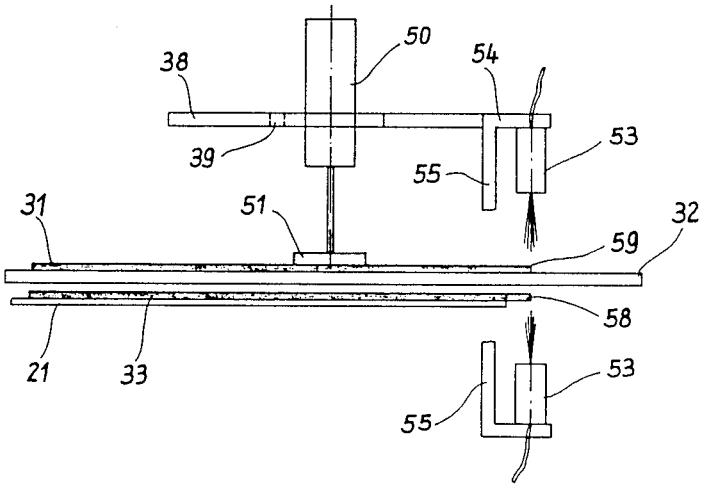

FIG. 1 a schematic top plan view of a sewing arrangement for the fully automatic production of e.g. pillow cases;

FIG. 2 a top plan view of a section of fabric folded in the sewing arrangement of FIG. 1, the two layers of which are shifted in respect to each other;

FIG. 3 a view similar to that in FIG. 2 in which, however, the folded section of fabric is shown after the alignment of the edges;

FIG. 4 a schematic side view of the device used in the sewing arrangement according to FIG. 1 for the alignment of the edges of the two layers of each folded section of fabric;

FIG. 5 a top view of the alignment device shown in FIG. 4;

FIG. 6 a detail of the alignment device in the area of its sensing device consisting of e.g. photoelectric cells; and FIGS. 7–9 are different schematic side views of a part of the alignment device in the area of its photoelectric cells.

The sewing arrangement shown in FIG. 1 is used, for example, for producing pillow cases 10 open on one side 11 and closed by seams on the opposite side 12 as well as along the edge 13 opposite the folded edge 14. An almost completed pillow case 10 is shown in the lower right part of FIG. 1.

To produce the individual pillow cases 10, first a fixed length of the fabric is pulled off a fabric supply 16 which can be, for example, a stack of fabric, crosswise across a first transporting device 17 by means of a draw-off device 15. For this purpose the draw-off device 15 has a plurality of grippers 18 which grasp the section of fabric by a lateral edge and which are fixed on an arm 19, and are movable back and forth by an actuating cylinder 20. The actuating cylinder 20 is fixed to a base plate 21 of the sewing arrangement. A separating knife, also fastened to the base plate 21, is designated by 22 and is movable up and down around a horizontal axis 23 by a drive means. (not shown) Each time the draw-off device 15 has drawn a predetermined length of the section of fabric across the first transporting device 17, the separating knife 22 operates to cut off a section from the remainder of the section of fabric of fabric 24, from which a pillow case 10 is to be made. In the exemplary embodiment the section of fabric has, on its right longitudinal edge 25 according to FIG. 1, a seam 26 which limits the open edge 11 in the completed pillow case 10.

The first transporting device 17 consists of a plurality of endless conveyor belts 27 rotating over rollers (not shown) which are intermittently driven by a drive motor (not shown). In order to transport a section of fabric 24, a length of fabric is cut off by the separating knife 22, after it has been released by the draw-off device 15, and moved towards the right, according to FIG. 1, to a folding station 28. At the folding station 28 the section of fabric 24 is folded around a plaiting tongue 30 by means of a folding bar 29 which is movable back and forth across the direction of transport of the first transporting device 17. The upper layer 31 of the section of fabric 24 rests on an aligning plate 32, while the lower layer 33 of the respective section of fabric 24 is underneath the said aligning plate 32 so as to rest on the base plate 21. The plaiting tongue 30 is aligned with the aligning plate 32. The folding bar 29 is intermittently pushed back and forth in the direction of the arrow by an actuating cylinder 34 which is fixed to the base plate 21. The actuating cylinders 20 and 34 can be, for example, compressed air cylinders. During the back and forth movement of the folding bar 29 a section of fabric 24 is folded around the plaiting tongue 30 and the transporting device 17 is turned off. It only resumes functioning when a freshly cut-off section of fabric 24 is inserted into the folding station 28 and a folded and aligned section of fabric 24 is moved out of the folding station 28 to the right according to FIG. 1.

The plaiting tongue 30 and the aligning plate 32 are supported above the conveyor belts 27 of the transporting device 17 by an arm 35 extending across said conveyor belts 35 and fastened to the base plate 21. For reasons yet to be discussed, the plaiting tongue 30 can, in accordance with FIG. 5, be shifted slighly offset to the direction of transport in the direction of the arrow.

As a rule, after a section of fabric 24 has been folded in the folding station 28 there exists an offset or, respectively, a shift between the upper layer 31 and the lower layer 33 of the respective section of fabric 24, necessitating an alignment of the edges prior to the folded section of fabric 24 being moved out of the folding station 28. For this purpose an alignment device 36 which is adjustable depending on the offset or the shift of the two layers 31, 33 is provided above the aligning plate 32 and is described in detail below.

The alignment device 36 has an arm 41, pivotable around a vertical axis 40, in the form of an assembly consisting of three interconnected bars 37, 38 and 39, which form a triangle. The right, free end of the bar 35 according to FIGS. 4 and 5 is connected with a bushing 42 disposed on a vertical axle stump 43, which is supported by an arm 44. The arm 44 is fastened to the base plate 21 of the sewing arrangement. Thus the arm 41 or the assembly can be pivoted in a plane extending parallel to the aligning plate 32 or to the upper and lower layers 31, 33 of a section of fabric 24. A tension spring 45 acts on the bar 37 which is fastened on a fixed part (not shown) of the sewing arrangement and attempts to turn the arm 41 or the assembly in a clockwise direction around the axis 40 (FIG. 5). Furthermore, a roller 46 is disposed on the bar 37 and is held against a control disk 47 by a tension spring 45. The control disk 47 fastened eccentrically on the shaft of an electric drive motor 48 which can drive the control disk 47 in both directions. The motor 48 is fastened on a plate 49 which is fixed on the machine frame (not shown) of the arrangement.

At the connecting point of the bars 37 and 38 of the pivot arm 41 there is disposed an actuating cylinder 50 for an aligning foot 51. The free extended end of the bar 38 has a further actuating cylinder 50 for an alignment foot 51. The aligning feet 51 can be lifted and lowered by means of the actuating cylinders 50 and they press the upper layer 31 against the aligning plate 32 in their lowered position. The aligning feet 51 can be provided on their underside with a rubber-like covering. Furthermore, the disposition of the aligning feet 51 on the pivot arm 41 is such that in the lowered position they can act on the upper layer 31 in the vicinity of the edge opposite the folded edge 14 in the area of the two corners of this upper layer (FIGS. 2, 3 and 5). At least one of the actuating cylinders 50 with the aligning foot 51 can also be pivotably disposed on the pivot arm 41 in order to make a possible adaptation to fabric sections of different sizes.

The extent of the pivoting movement of the pivot arm 41 is controlled by a sensing device which senses the offset or the shift of the two layers 31, 33 of the section of fabric 24. It contains in the exemplary embodiment two photoelectric cells 53 fastened at a vertical distance from each other in alignment on an arm 54. The arm 54 is fastened on the bar 39 of the pivot arm 41 so that the photoelectric cells 53 move with the arm 41. The lower photoelectric cell 53 is supported by a part 55 extending through a cut-out 560 in the aligning plate 32 and is fastened on the arm 54. A further photoelectric cell 56 is supported by an arm 57 fixedly provided on the machine frame. Thus the photoelectric cell 56 is stationary. Its purpose is to scan the advancing edge 58 of a section of fabric 24 transported into the folding station 28 by the transporting device 17 and to shut off the transporting device 17 via a sequence control (not shown) and to switch on the folding bar 29. After the section of fabric 24 has been folded by the folding bar 29, the aligning process which is also initiated by the sequence control (not shown) begins. For this purpose, first the drive motor 48 is switched on in order to turn the pivot arm 41 in accordance with FIGS. 2, 3 and 5 via the control disk 47 counterclockwise around the axis 40 until the upper photoelectric cell 53 has reached the edge 59 of the upper layer 31. Then the actuating cylinders 50 are activated by means of the said sequence control to press the aligning feet 51 against the upper layer 31 and thus against the aligning plate 32. At the same time the counterclockwise pivoting of the arm 41 around the axis 40 is continued and the upper layer 31 is carried along in the same direction. This movement lasts until the edge 59 of the upper layer 31 is aligned with the edge 58 of the lower layer 33 (FIG. 3 and FIG. 9). Then the aligning feet 51 are again lifted by the actuating cylinders 50 and the drive motor 48 is reversed in order to turn the control disk 47 in the opposite direction so that the tension spring 45 can turn the pivot arm 41 clockwise around the axis 40 back into the initial position. The respective section of fabric 24 is now aligned with its edges and can be sewn together successively along its edges 13 and 12.

When the aligning process has ended, the second transporting device 60 moves into action to transport the folded and aligned section of fabric 24 through a first sewing station 61, where the upper and lower layers 31 and 33 are sewn together along the edges 52 and 52' (FIG. 2) which are opposite from the folded edge 14. In accordance with FIG. 1, for example, the second transporting device 60 has only two endless conveyor belts 62. The second transporting device 60 is provided at each conveyor belt 62 with a take-up section 63 which can be pivoted up and down for taking up and transporting the folded and aligned sections of fabric 24. The pivoting of these take-up sections 63 is accomplished by means of an actuating cylinder 64 fixedly attached to the machine frame. To take up an aligned section of fabric 24, the take-up sections 63 are pivoted down and the one take-up section 63 dips into the cut-out 560 of the aligning plate 32. As shown in FIG. 4 the take-up sections 63 are pivoted up during the alignment of a folded section of fabric 24.

Once the sections of fabric 24 have passed the first sewing station 61, they are transported further to the right in accordance with FIG. 1 where they are taken up at the end of the second transporting device 60 by a third transporting device 65, disposed at right angles to the transporting device 60, also having as shown in FIG. 1, for example, only two endless conveyor belts 66. The transporting device 65 transports the sections of fabric 24 through a second sewing station 67 where the upper and lower layers 31, 33 are sewn together on the aligned edges 68, 68' (FIGS. 2 and 3). After leaving this second sewing station 67, the finished pillow cases 10 are transported by the transporting device 65 to, for example, a collector (not shown).

It will be noted that the conveyor belts of all transporting devices 17, 60 and 65 cooperate with the base plate 21 during transport of the sections of fabric 24 or the finished pillow cases 10. This is also true for the take-up sections 63 of the transporting device 60. The drive motors of the transporting devices 17, 60 and 65 are switched by means of the electric sequence control.

To increase the sensitivity of the photoelectric cells 53 and 56, corresponding reflector strips 69 are fastened on the surface and underside of the aligning plate 32 (FIG. 6).

Because of the ability to adjust the plaiting tongue 30 in a plane aligned with the aligning plate 32 such that it lies at a slight angle to the transport direction of the transporting device 17, the offset or, respectively, shift between the upper and lower layers 31, 33 of each section of fabric 24 is pre-programmed during the folding of a section of fabric 24 by the folding bar 29, which eases the subsequent edge alignment of the upper layer 31, resting on the aligning plate 32, in respect to the lower layer 33.

We claim:

1. A sewing arrangement for covers of fabric materials, e.g. pillow cases, bed sheets or the like, where sections cut from a supply of fabric are made into individual covers, characterized in that (a) a first transporting device (17) which moves the sections of fabric (24) to a folding station (28) where a folding bar (29), being movable back and forth in a direction crosswise to the direction of movement of the first transport device (17), folds each section of fabric (24) across an alignment plate (32) such that one layer (31) of each section of fabric (24) is above the alignment plate (32) and the other (33) below the alignment plate (32), (b) a device, disposed above the alignment plate (32) and controllable in respect to the offset of the two layers (31, 33), for the edge-aligned positioning of the upper layer (31) disposed on top of the alignment plate (32) in respect to the lower layer (33) of each section of material (24), (c) a second transporting device (60) for taking up and further transporting the folded and aligned sections of fabric (24) to a first sewing station (61) where the folded layers (31, 33) of the sections of fabric (24) are sewn together along two aligned edges (52, 52'), and (d) a third transporting device (65), disposed at right angles to the second transporting device (60) for taking up and further transporting the sections of fabric (24) to a second sewing station (67) where the folded layers (31, 33) of the sections of fabric (24) are sewn together along two additional aligned edges (68, 68').

2. A sewing arrangement in accordance with claim 1, characterized in that the device (36) for the edge-aligned positioning of the two layers (31, 33) of each section of fabric (24) is movable up and down and pivotable around a vertical axis.

3. A sewing arrangement in accordance with claim 2, characterized in that the aligning device (36) has at least two aliging feet (51) which are disposed on an arm (41) pivotable around a vertical axis (40) such that they act on the upper layer (31) of each section of fabric (24) in the vicinity of the edge (52) opposite the folded edge (14).

4. A sewing arrangement in accordance with claim 3, characterized in that the aligning feet (51) are disposed on the pivoting arm (41) such that they act in the area of the two corners of the upper layer (31) of each folded section of fabric (24).

5. A sewing arrangement in accordance with claim 3, characterized in that the aligning feet (51) are disposed on the pivoting arm (41) movable upwards and downwards by actuating cylinders (50).

6. A sewing arrangement in accordance with claim 3, characterized in that the pivot arm (41) of the aligning device (36) is pivoted by a control disk (47) driven by a motor during the aligning process.

7. A sewing arrangement in accordance with claim 6, characterized in that the extent of the pivoting of the pivot arm (41) supporting the aligning feet (51) is controlled by a sensing device which senses the offset or, respectively, the shift of the two layers (31, 33) of each section of fabric (24).

8. A sewing arrangement in accordance with claim 7, characterized in that the sensing device has at least three sensors, e.g. photoelectric cells (53, 56), two (53) of which are disposed above each other on the pivot arm (41) of the aligning device (36) and the third (56) fixedly on the frame of the sewing arrangement.

9. A sewing arrangement in accordance with claim 8, characterized in that, when photoelectric cells (53, 56) are used as sensors, they cooperate with fixed reflector strips (69).

10. A sewing arrangement in accordance with claim 1, characterized in that the second transporting device (60) for taking up and transporting the folded and aligned sections of fabric (24) has vertically pivotable take-up sections (63) which are pivoted up during the alignment of each folded section of fabric (24) and are pivoted down to take up the aligned sections of fabric (24).

11. A sewing arrangement in accordance with claim 10, characterized in that at least one cut-out (560) for the passage of at least one take-up section (63) of the second transporting device (60) is provided.

12. A sewing arrangement in accordance with claim 3, characterized in that the pivot arm (41) consists of an assembly formed by bars (37, 38, 39) and is in general triangular when viewed from above.

13. A sewing arrangement in accordance with claim 1, characterized in that the folding of the sections of fabric (24) takes place around a plaiting tongue (30) which is adjustable in a plane aligned with the aligning plate (32).

14. A sewing arrangement in accordance with claim 5, characterized in that at least one actuating cylinder (50) is pivotably disposed with its aligning foot (51) on the pivot arm (41).

* * * * *